US006191534B1

(12) United States Patent
Schuler et al.

(10) Patent No.: US 6,191,534 B1
(45) Date of Patent: Feb. 20, 2001

(54) LOW CURRENT DRIVE OF LIGHT EMITTING DEVICES

(75) Inventors: Jeffrey A. Schuler, San Jose; Yang Zhao, Fremont; John Brummer, Saratoga, all of CA (US)

(73) Assignee: Infineon Technologies North America Corp., San Jose, CA (US)

( * ) Notice: Under 35 U.S.C. 154(b), the term of this patent shall be extended for 0 days.

(21) Appl. No.: 09/357,786

(22) Filed: Jul. 21, 1999

(51) Int. Cl.[7] ..... G09G 3/12
(52) U.S. Cl. ..... 315/169.3; 345/77
(58) Field of Search ..... 315/169.3, 169.4; 345/42, 55, 76, 77, 204, 208, 212

(56) References Cited

U.S. PATENT DOCUMENTS 3,763,468 * 10/1973 Ovshinsky et al. ..... 340/166 EL
4,731,610 * 3/1988 Baron et al. ..... 340/784
5,608,339 * 3/1997 Fugiwara ..... 326/27
5,723,950 * 3/1998 Wei et al. ..... 315/169.3
5,745,089 * 4/1998 Taguchi et al. ..... 345/89
5,767,823 * 6/1998 Hush ..... 345/55
5,828,181 10/1998 Okuda ..... 315/169.3
5,998,805 * 12/1999 Shi et al. ..... 257/40
6,088,490 * 7/2000 Iwata et al. ..... 382/312

* cited by examiner

*Primary Examiner*—Don Wong
*Assistant Examiner*—Thuy Vinh Tran

(57) ABSTRACT

Control circuitry for an array of light emitting devices includes a first column line connected to each light emitting device in a column of light emitting devices. First column circuitry includes a first current source and a second current source. The first current source is connected to the first column line. The second current source is connected to the first column line. When a first light emitting device from the column of light emitting devices is to be turned on, the first current source is turned on until a voltage on the first column line is equal to a predetermined voltage. Then the first current source is turned off and the second current source supplies current sufficient to cause the first light emitting device to emit light to a first brightness level.

20 Claims, 5 Drawing Sheets

LOW CURRENT DRIVE OF LIGHT EMITTING DEVICES

BACKGROUND

1. Field of the Invention

The present invention pertains to circuitry for driving light emitting devices and pertains particularly to the low current drive of organic light emitting diodes.

2. Related Information

The organic light emitting diode (OLED) technology provides a low current emissive display technology. However, a large array of OLEDs contains a large amount of capacitance. This capacitance must be charged and discharged during multiplexed operation.

An equivalent circuit for an OLED pixel is a capacitor in parallel with the emitting diode. Typically the anodes of each OLED is driven by a current source since the pixel Vf may vary for individual OLEDs across an OLED array.

A typical implementation of circuitry which drives an array of OLEDs is using current sources to drive a column line for each column of an OLED array. The anode of each OLED is connected to a corresponding column line. The cathodes of each OLED is connected to a corresponding row line of the OLED matrix. Each row line has a switch. The switches enable one row at a time.

For background information on circuitry for driving OLEDs, see for example, U.S. Pat. No. 5,828,181 issued to Yohiyuki Okuda on Oct. 27, 1998 for DRIVING CIRCUIT FOR AN ORGANIC ELECTROLUMINESCENT ELEMENT USED IN A DISPLAY.

SUMMARY OF THE INVENTION

In accordance with the preferred embodiment of the present invention, control circuitry for an array of light emitting devices includes a first column line connected to each light emitting device in a column of light emitting devices. First column circuitry includes a first current source and a second current source. The first current source is connected to the first column line. The second current source is connected to the first column line. When a first light emitting device from the column of light emitting devices is to be turned on, the first current source is turned on until a voltage on the first column line is equal to a predetermined voltage. Then the first current source is turned off and the second current source supplies current sufficient to cause the first light emitting device to emit light to a first brightness level.

The present invention provides low power operation of a row of light emitting devices. Various embodiments of the invention also allow for reduced complexity when implementing control circuitry for the row of light emitting devices.

DESCRIPTION OF THE PREFERRED EMBODIMENT

Figure 1:
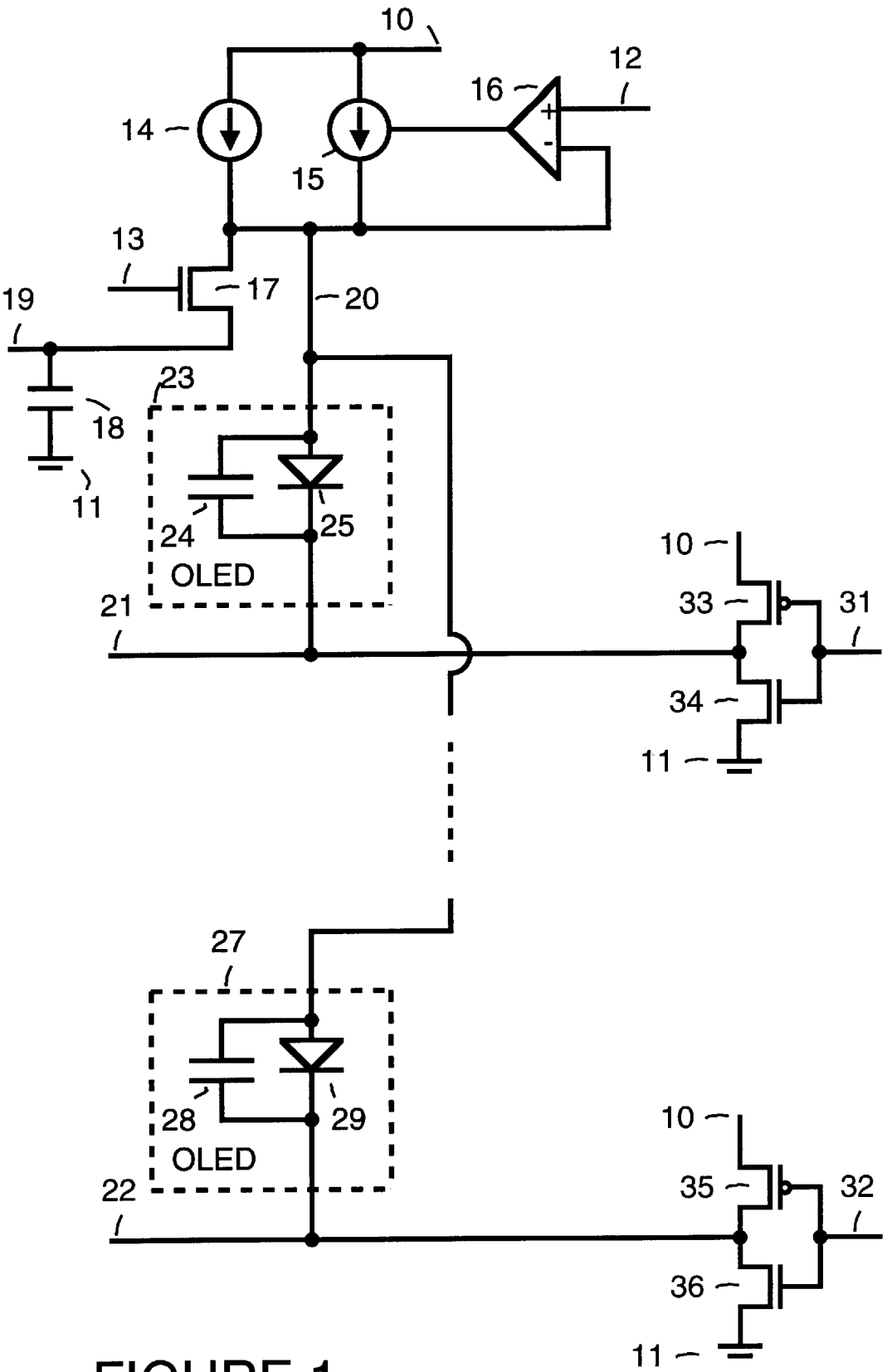
FIG. 1 is a schematic which shows circuitry used to drive a light emitting device array in accordance with a preferred embodiment of the present invention.

FIG. 1 is a schematic which shows circuitry used to drive an array of light emitting devices. For example, each light emitting device is an organic light emitting diode (OLED) device. A column of light emitting devices is represented by a light emitting device 23 and a light emitting device 27. Light emitting device 23 is the first light emitting device in the column and light emitting device 27 is the last light emitting device in the column. Any number of light emitting devices may be connected within the column between light emitting device 23 and light emitting device 27. A typical array of light emitting devices has 100 columns and 64 rows for a total of 6400 light emitting devices.

Each light emitting device may be represented by a diode connected in parallel with a capacitance. For example, light emitting device 23 includes a diode 25 and a capacitance 24, connected as shown. Light emitting device 27 includes a diode 29 and a capacitance 28, connected as shown.

Drive circuitry is used to provide current for each column. The drive circuitry for a column line 20 to which light emitting device 23 and light emitting device 27 are connected consists of a current source 15, a comparator 16, a current source 14 and a transistor 17. For example, current source 14 generates 60 microamps of current. Current source 15 can implemented, for example, as a switch that when turned on connects high pixel voltage line 10 to column line 20.

A row line is connected to each light emitting device in a row. Thus row line 21 is connected to all the light emitting devices in the same row as light emitting device 23. Row line 22 is connected to all the light emitting devices in the same row as light emitting device 27. Switches connected to each row line assure that only one row is enabled at a time. Row line 21 is controlled by a switch consisting of a transistor 33 and a transistor 34 connected in an inverter configuration, as shown. The switch is controlled by a switch input 31. Row line 22 is controlled by an switch consisting of a transistor 35 and a transistor 36 connected in an inverter configuration, as shown. The switch is controlled by a switch input 32.

On high pixel voltage line 10, a voltage is placed sufficient to accommodate the Vf of the light emitting devices. Typically, this is in the range of 8 to 10 volts. On a high logic voltage line 19 a voltage is placed sufficient to accommodate other logic circuitry on the device. Typically, this is in the range of 2.7 to 5 volts. Voltage is measured from a ground 11. A capacitance 18 represents the capacitance of a logic power supply which supplies the high logic voltage. A control input 13 controls switching of transistor 17. The signal on control input 13 is pulse width modulated to allow for brightness control.

The use of two current sources for each column facilitate implementation of a global brightness control using pulse width modulation. Specifically, while the diode of each light emitting device requires only a low current to generate light, a relatively substantial amount of current is required to charge the capacitance within the light emitting device. If current source 14 is used as a single current source to generate the low amount of current necessary to generate light in a light emitting device, the pixel current generated by current source 14 would take a substantial portion of the time that each row is enabled to charge the column to the required activation voltage (Vf) of an active light emitting device. Pulse width modulation of the signal on control input 13 results in even less current being available to charge the column.

The addition of large current source 15 provides a lot of current at the beginning of each column cycle to charge the column to a predetermined voltage. During the charging period, a reference voltage equivalent to the predetermined voltage is placed on a reference voltage line 12. Once the predetermined voltage is reached, comparator 16 shuts off current source 15. Current source 15, then, provides a "fast charge" current to charge the capacitance of the active light emitting device in the column before allowing current source 14 to take over and supply the desired pixel current. This allows current source 14 to provide sufficient current to cause an activated light emitting device to generate light for a substantial portion of the column cycle. This enables predictable brightness control with pulse width modulation.

A typical low power application has a logic power supply of 2.7 volts to 5 volts. An light emitting device, however, typically requires 8 volts to 10 volts to accommodate the Vf of the light emitting device. Thus to generate a high voltage to place on a high voltage line 10, a voltage multiplier is used.

Figure 2:
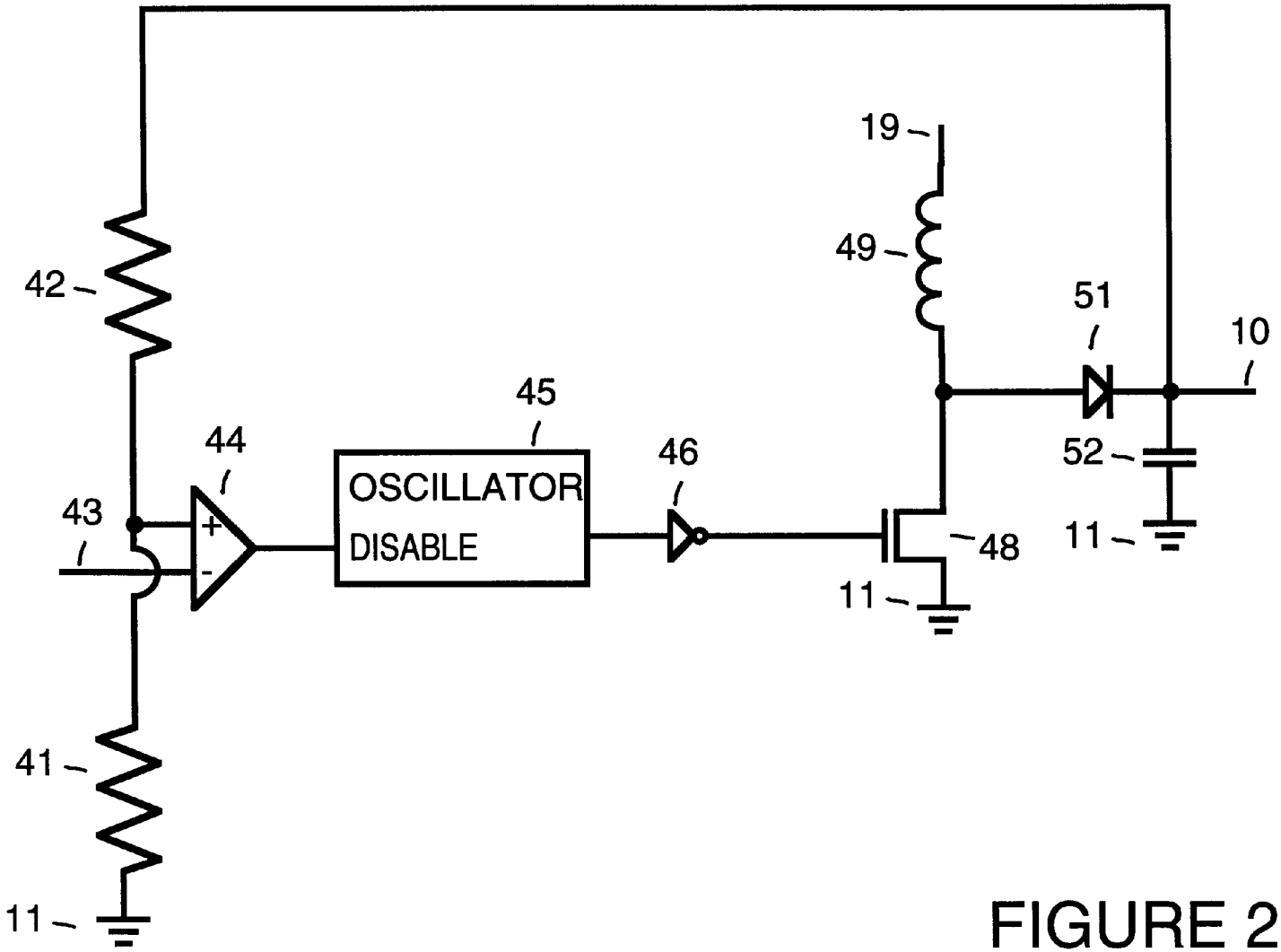
FIG. 2 shows a voltage multiplier used to provide a high voltage for driving the light emitting device array shown in FIG. 1.

FIG. 2 shows a voltage multiplier including a resistor 41, a resistor 42 a comparator 44 an oscillator 45, an inverter 46 a transistor 48, an inductor 49, a diode 51 and a capacitor 52 connected as shown.

For example, resistor 41 has a value of 62 kilohms. Resistor 42 has a value of 455 kilohms. Inductor 49 has a value of 22 microhenries. Capacitor 52 has a value of 10 microfarads. Diode 51 is a Schottky diode. When not disabled by a signal from comparator 44, oscillator 45 generates a signal having a frequency of 60 kilohertz. A reference voltage of 1.2 volts is placed on a reference voltage line 43. A ground line 11 is at 0 volts. On high logic voltage line 19, a voltage of 2.7 volts is placed. The voltage multiplier places a 10 voltage DC signal on high pixel voltage line 10. The DC signal on high pixel voltage line 10 is stored in capacitor 52.

Figure 3:
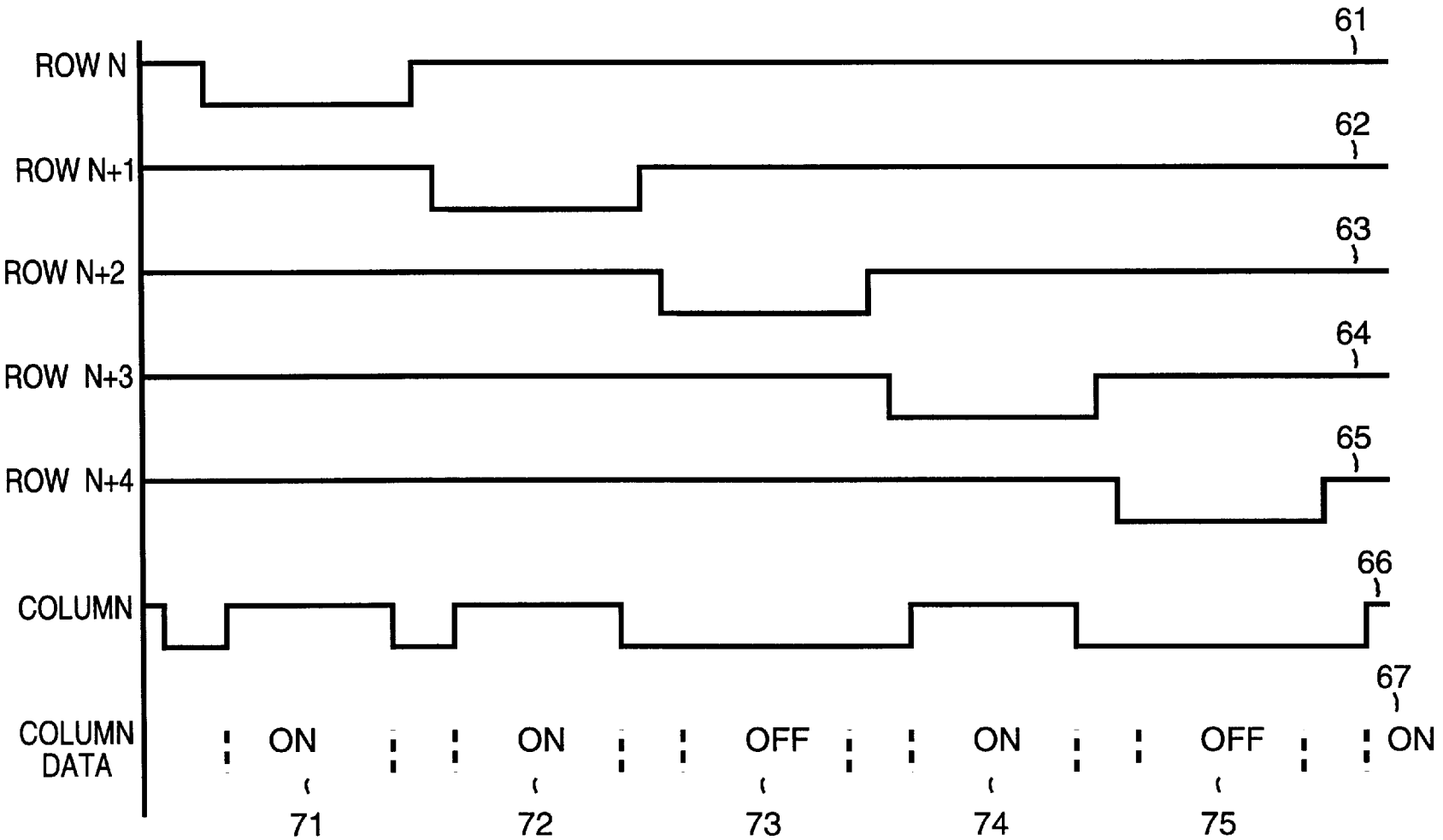
FIG. 3 shows a timing diagram for signals within the light emitting device array shown in FIG. 1 in accordance with a preferred embodiment of the present invention.

FIG. 3 shows a simplified timing diagram which explains the operation of the circuitry shown in FIG. 1. A waveform 61 represents the signal on a row line for a row "n". For example, row "n" represents the row which contains light emitting device 23. Therefore, waveform 61 represents the signal on row line 21. A waveform 62 represents the signal on a row line for a row "n+1". A waveform 63 represents the signal on a row line for a row "n+2". A waveform 64 represents the signal on a row line for a row "n+3". A waveform 65 represents the signal on a row line for a row "n+4".

A waveform 66 represents a signal placed on column line 20. Column data 67 indicates whether a light emitting device in an activated row will be on or off during a particular time period. "ON" indicates that a light emitting device in the column is to be turned on. "OFF" indicates that no light emitting device in the column is to be turned on.

At most, only one light emitting device is turned on at a time for each column. In order for a light emitting device to be turned on, the voltage on the column line connected to the light emitting device must be at Vf (e.g., 6 to 8 volts) or greater and the voltage on the row line must be at low voltage (e.g., 0 volts). Thus for light emitting device 23 to be turned on, column line 20 must be at Vf or greater (e.g., 6 to 8 volts) and row line 21 must be at low voltage (e.g., 0 volts). For light emitting device 27 to be turned on, column line 20 must be at Vf or greater (e.g., 6 to 8 volts) and row line 22 must be at low voltage (e.g., 0 volts).

The times that the row lines are brought to low voltage are staggered , so that at most only one light emitting device is turned on at a time for each column. Thus, at a time period 71, the row line for row n (i.e., row line 21) is at low voltage. All other rows remain at high voltage. At a time period 72, the row line for row n+1 is at low voltage. All other rows remain at high voltage. At a time period 73, the row line for row n+2 is at low voltage. All other rows remain at high voltage. At a time period 74, the row line for row n+3 is at low voltage. All other rows remain at high voltage. At a time period 75, the row line for row n+4 is at low voltage. All other rows remain at high voltage.

In order for the column charge time to be independent of the previous state of the array of light emitting devices, at the beginning of each column cycle, all the row lines are at the high voltage and all the column lines, including those that were turned on in the previous column cycle, are placed at the column low voltage. As a result of this, all light emitting devices are reverse biased at the beginning of a new column cycle. This is illustrated in FIG. 3 by waveform 66 being at column low voltage (e.g. 2.7 volts) between time period 71 and time period 72, between time period 72 and time period 73, between time period 73 and time period 74 and between time period 74 and time period 75.

For each column, during the time period when each row line is brought to low voltage, if the light emitting device for that column connected to that row line is to be turned on, the column line is brought to Vf or greater. Otherwise, the column line is left at column low voltage.

For example, in time period 71, the light emitting device (i.e., light emitting device 23) in row n (i.e., connected to row line 21) is to be turned on. Therefore, in time period 71, column 20 is driven to a voltage that is equal to or greater than Vf. In time period 72, the light emitting device in row n+1 is to be turned on. Therefore, in time period 72, column 20 is driven to a voltage that is equal to or greater than Vf. In time period 73, the light emitting device in row n+2 is to be turned off. Therefore, in time period 73, column 20 remains at column low voltage. In time period 74, the light emitting device in row n+3 is to be turned on. Therefore, in time period 74, column 20 is driven to a voltage that is equal to or greater than Vf. In time period 75, the light emitting device in row n+4 is to be turned off. Therefore, in time period 75, column 20 remains at column low voltage.

When column line 20 is at Vf or greater, one row line is switched to the low voltage and all the other row lines are switched to the high voltage. This reduces the current actually drawn from the power supply. For example, when light emitting device 23 is turned off, transistor 31 connects row line 21 to high voltage line 10. Any current that travels through light emitting device 21 travels to high voltage line 10 and back into capacitor 52 of the high voltage multiplier shown in FIG. 2.

When light emitting device 23 is turned on, column line 20 is at the Vf or greater and row line 21 is connected to ground 11. This results in charging capacitance 24. Once the voltage across capacitance 24 is greater than Vf, diode 25 generates light. Any current that travels through the capacitance of other light emitting devices in the column travels to high voltage line 10 and back into capacitor 52 of the high voltage multiplier shown in FIG. 2.

In the preferred embodiment, column low voltage is at 2.7 volts. This is equivalent to the logic high voltage for logic circuitry. The reason this is done is because the logic power supply supplied voltage of 2.7 volts is below the minimum Vf required to turn on a light emitting device. When a column makes a transition from Vf or greater to column low voltage, charge remains in the capacitance for the light emitting device that was "on" and to a lesser degree in capacitance for other light emitting devices. This charge is used to charge the capacitance of the logic voltage supply.

For example, in time period 71, light emitting device 23 is turned on. At the end of time period 72, transistor 17 is turned on and column line 20 is electrically connected through high logic voltage line 19 to capacitance 18 of the logic power supply. Capacitance 24 thus discharges into capacitance 18.

While in the preferred embodiment, at the beginning of each column cycle, the column lines that were turned on in the previous column cycle are driven low. In an alternate embodiment of the present invention, further reduction of the column charge and discharge currents is achieved by logically detecting that a column line has been on during activation of one row line and will remain on during activation of the next row line. When this case is detected, column line is not discharged, but remains at Vf. In this embodiment, waveform 66, shown in FIG. 3, would remain at Vf between time period 71 and time period 72. Waveform 66 would still be at column low voltage (e.g. 2.7 volts) between time period between time period 72 and time period 73, between time period 73 and time period 74 and between time period 74 and time period 75.

Also, in the preferred embodiment a comparator is tied to a high current supply for each column. Thus there are as many comparators as there are columns. In an alternative embodiment of the present invention, instead of using a separate comparator to monitor each column of the array, only one comparator is used. This single comparator is tied to a current source and capacitor which mirrors the fast charge current and column capacitance. This is illustrated by FIGS. 4 and 5.

Figure 4:
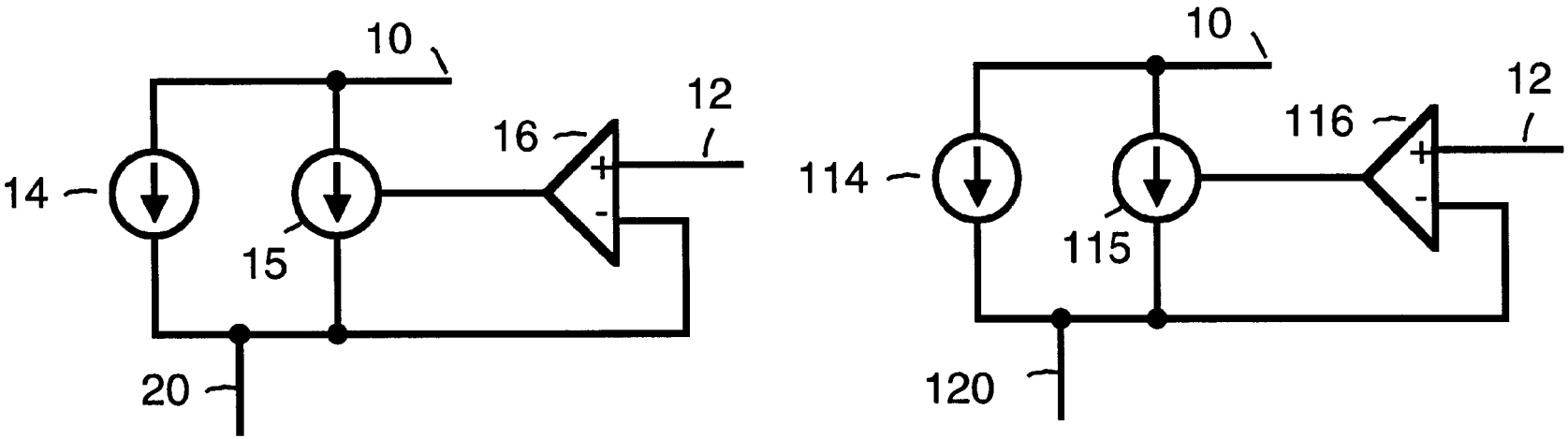
FIG. 4 is a schematic which shows additional circuitry used to drive a light emitting device array in accordance with the preferred embodiment of the present invention.

FIG. 4 illustrates the preferred embodiment. In the preferred embodiment a comparator is tied to a high current supply for each column. Thus driving circuitry for column line 20 includes pulse modulated current source 14, high current source 15 and comparator 16. The driving circuitry for a column line 120 includes a pulse modulated current source 114, a high current source 115 and a comparator 116.

Figure 5:
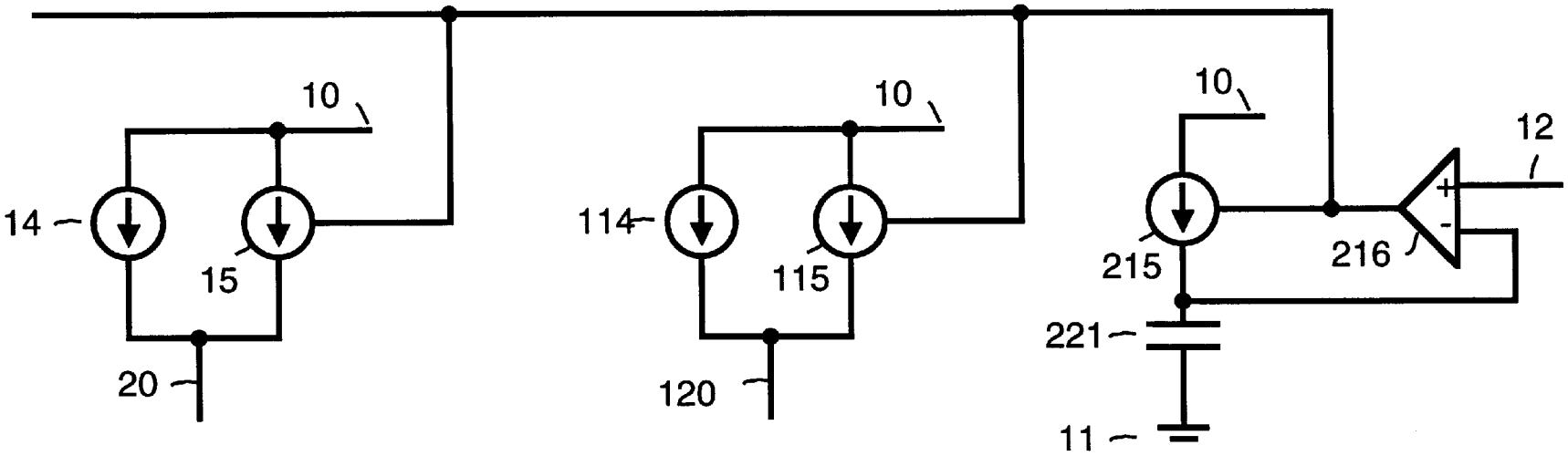
FIG. 5 is a schematic which shows additional circuitry used to drive a light emitting device array in accordance with an alternative preferred embodiment of the present invention.

FIG. 5 illustrates the alternative embodiment. In the alternative embodiment only comparator 216 is used. Comparator 216 is tied to a current source 215 and a capacitor 221. Current source 215 and a capacitor 221 mirror the fast charge current and column capacitance. Comparator 216 is used to control high current source 15 connected to column line 20, and to control high current source 115 connected to column line 120. Comparator 16 and comparator 116 are no longer required.

In the above description of the preferred embodiment, circuitry that controls an array of organic light emitting diodes is described. However, as will be understood by a person of ordinary skill in the art, the above described circuitry can be used with great benefit to drive an array of any type of light emitting device in which there is some capacitance which is charged before a light emitting device turns on.

What is claimed is:

1. Control circuitry for an array of light emitting devices, circuitry comprising:

a first column line connected to each light emitting device in a column of light emitting devices;

first column circuitry comprising:

a first current source connected to the first column line, and a second current source connected to the first column line;

wherein when a first light emitting device from the column of light emitting devices is to be turned on, the first current source is turned on until a voltage on the first column line is equal to a predetermined voltage, then the first current source is turned off and the second current source supplies current sufficient to cause the first light emitting devices to emit light to a first brightness level.

2. Control circuitry as in claim 1 wherein the second current source is pulse width modulated to allow adjustment of brightness level.

3. Control circuitry as in claim 1, wherein the first column circuitry additionally comprises:

a switch connected to the first column line and to an output capacitance of a low voltage power supply;

wherein when the voltage on the first column line is to be discharged, the switch is turned on allowing the voltage to be discharged to the output capacitance of the low voltage power supply.

4. Control circuitry as in claim 1, wherein the first column circuitry additionally comprises:

a comparator which compares a reference voltage on a reference voltage line to the voltage on the first column line, the comparator controlling the first current source;

wherein the comparator turns off the first current source when the voltage on the first column line is equal to the reference voltage.

5. Control circuitry as in claim 1 additionally comprising:

a second column line;

second column circuitry comprising:

a third current source connected to the second column line, and a fourth current source connected to the second column line.

6. Control circuitry as in claim 5 additionally comprising:

a capacitance;

a fifth current source which charges the capacitance, a comparator which compares a reference voltage on a reference voltage line to a voltage across the capacitance, the comparator controlling the first current source, the third current source and the fifth current source;

wherein the comparator turns off the first current source when the voltage across the capacitance is equal to the reference voltage.

7. Control circuitry as in claim 1 additionally comprising:

a power supply having an output on which is placed a signal with a voltage high enough to turn on light emitting devices from the array of light emitting devices;

a plurality of row lines;

a plurality of switches, each switch connected to an associated row line from the plurality of row lines, each switch connecting the associated row line to either the output of the power supply or to ground.

8. Control circuitry as in claim 1 wherein the array of light emitting devices is an array of organic light emitting diodes.

9. A method for controlling an array of light emitting devices comprising the following steps:

(a) when a first light emitting device from a column of light emitting devices is to be turned on, charging capacitance of the first light emitting device utilizing a first current source until a voltage across the first light emitting device is equal to a predetermined voltage;

(b) when the voltage across the first light emitting device is equal to the predetermined voltage, shutting off the first current source; and, (c) utilizing a second current source to supply current sufficient to cause the first light emitting device to emit light to a first brightness level.

10. A method as in claim 9 wherein step (c) comprises the following substep:

(c.1) pulse width modulating the second current source to allow adjustment of brightness level.

11. A method as in claim 9, additionally comprising the following step:

(d) when the first light emitting device is to be turned off, discharging the capacitance of the first light emitting device to output capacitance of a low voltage power supply.

12. A method as in claim 9, wherein step (a) includes the following substep:

(a.1) comparing a reference voltage on a reference voltage line to the voltage across the first light emitting device.

13. A method as in claim 12, wherein step (b) includes the following substep:

(b.1) turning off the first current source when the voltage across the first light emitting device is equal to the reference voltage.

14. A method as in claim 9, wherein step (a) includes the following substeps:

(a.2) while charging the capacitance of the first light emitting device also charging a mirror capacitance using a third current source;

(a.1) comparing a reference voltage on a reference voltage line to the voltage across the mirror capacitance.

15. A method as in claim 14, wherein step (b) includes the following substep:

(b.1) turning off the first current source when the voltage across the mirror capacitance is equal to the reference voltage.

16. A method as in claim 9 additionally comprising the following step:

(d) when the first light emitting device is turned off, reverse biasing the first light emitting device such that charge stored in the light emitting device flows back into a capacitor on a voltage supply.

17. A method as in claim 9 wherein the array of light emitting devices is an array of organic light emitting diodes.

18. Control circuitry for an array of light emitting devices, circuitry comprising:

a first column line connected to each light emitting device in a column of light emitting devices; and, first column circuitry comprising:

a current supply used to supply current to selected light emitting devices in the column of light emitting devices, and a switch connected to the first column line and to an output capacitance of a low voltage power supply;

wherein when the voltage on the first column line is to be discharged, the switch is turned on allowing the voltage to be discharged to the output capacitance of the low voltage power supply.

19. Control circuitry as in claim 18 additionally comprising:

a power supply having an output on which is placed a signal with a voltage high enough to turn on light emitting devices from the array of light emitting devices;

a plurality of row lines;

a plurality of switches, each switch connected to an associated row line from the plurality of row lines, each switch connecting the associated row line to either the output of the power supply or to ground.

20. Control circuitry as in claim 18 wherein the array of light emitting devices is an array of organic light emitting diodes.

* * * * *